US006527108B1

(12) United States Patent
Blin et al.

(10) Patent No.: US 6,527,108 B1
(45) Date of Patent: Mar. 4, 2003

(54) ARTICLE CARRIER

(75) Inventors: Patrick Blin, Chateauroux (FR); Alain Saulas, Chateauroux (FR); Jean-Michel Auclair, Chateauroux (FR)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/664,461

(22) Filed: Sep. 18, 2000

Related U.S. Application Data

(63) Continuation of application No. PCT/US99/05761, filed on Mar. 16, 1999.

(51) Int. Cl.[7] ..... B65D 75/00

(52) U.S. Cl. ..... 206/148; 206/158; 206/434

(58) Field of Search ..... 206/140, 141, 206/147, 158–161, 199, 427–434, 148; 294/87.2

(56) References Cited

U.S. PATENT DOCUMENTS

| | | | | |
|---|---|---|---|---|
| 2,790,590 A | | 4/1957 | Toensmeier | |
| 2,801,001 A | | 7/1957 | Wolowicz | |
| 3,086,680 A | | 4/1963 | Graser | |
| 3,128,034 A | | 4/1964 | Weiss | |
| 3,140,036 A | | 7/1964 | Spery | |
| 3,407,921 A | | 10/1968 | Cilluffo | |
| 3,493,261 A | | 2/1970 | Funkhouser et al. | |
| 3,498,449 A | | 3/1970 | Spery | |
| 3,640,448 A | * | 2/1972 | Wood | 206/158 |
| 3,674,137 A | | 7/1972 | Graser | |
| 4,300,680 A | | 11/1981 | Champlin | |
| 4,378,878 A | | 4/1983 | Graser | |
| 4,463,852 A | | 8/1984 | Stone | |
| 4,498,582 A | | 2/1985 | Tomassi et al. | |
| 4,533,047 A | | 8/1985 | Calvert | |
| 4,545,485 A | | 10/1985 | Oliff | |
| 4,645,072 A | | 2/1987 | Lemon | |
| 5,297,673 A | | 3/1994 | Sutherland | |
| 5,524,756 A | | 6/1996 | Sutherland | |
| 5,549,197 A | | 8/1996 | Sutherland | |

FOREIGN PATENT DOCUMENTS

| | | |
|---|---|---|
| WO | 94/25363 | 11/1994 |
| WO | 96/17781 | 6/1996 |

* cited by examiner

*Primary Examiner*—Bryon P. Gehman
(74) *Attorney, Agent, or Firm*—Tsugihiko Suzuki

(57) ABSTRACT

An article carrier and blank for forming the article carrier are provided to package a plurality of necked articles. The carrier or blank comprises a top, bottom and opposed side panels interconnected together. The top panel comprises article receiving and retaining arrangement including an article retaining flap formed from the top panel. The article retaining flap is adapted to be folded inwardly of the top panel thereby to define an aperture for receiving a neck portion of the article. When the article neck portion is received in the aperture, the article retaining flap abuts the neck portion to engage and retain the article.

10 Claims, 6 Drawing Sheets

ARTICLE CARRIER

This is a continuation of international application No. PCT/US99/05761, filed Mar. 16, 1999, which is hereby incorporated by reference.

BACKGROUND OF THE INVENTION

This invention relates to article carriers and blanks which are particularly useful for carrying articles, for example, bottles. More particularly, the invention relates to an article carrier of the wrap-around type and is concerned with an improved article retention and carrier reinforcing feature which receive neck portions of bottles accommodated in the carrier.

Neck retention means in wrap-around carriers are well known. For example, U.S. Pat. No. 5,549,197 (Riverwood) illustrates a wraparound carrier incorporating downwardly folded retaining flaps struck from and connected to side panels of the carrier. The retaining flaps are used to support a neck portion of an article.

The present invention and its preferred embodiments seek to overcome or attempt mitigate the problems associated with the prior art.

SUMMARY OF THE INVENTION

One aspect of the invention provides an article carrier for containing a plurality of necked articles comprising a top, bottom and opposed side panels interconnected together, wherein the top panel comprises an article receiving and retaining arrangement including an article retaining flap formed from the top panel, which article retaining flap is adapted to be folded inwardly of the top panel thereby to define an aperture for receiving a neck portion of the article and wherein the article retaining flap abuts said neck portion to engage and retain said article.

According to an optional feature of this aspect of the invention, there further comprising a fold line extending across the article retaining flap such that the flap is folded along the fold line to define adjacent flap portions adapted to abut the neck portion at two positions thereby to improve article retention.

According to another optional feature of this aspect of the invention, the article receiving and retaining arrangement comprises a pair of complementary retaining flaps, each being hinged to on opposite edges of said aperture.

According to a further optional feature of this aspect of the invention, the hinged flap is foldably joined to the edge of the aperture along a fold line comprising two angularly related parts.

Optionally, the angularly related parts converge on a point where a pair of stress relief fold lines converge wherein the stress relief lines define therebetween an intermediate panel adjacent an end edge of the top panel.

According to a still further optional feature of this aspect of the invention, the article receiving and retaining arrangement may further comprise a second retaining flap formed from the top panel and folded inwardly of the top panel to define a second aperture for receiving the neck portion of another article. The top panel may further comprise a main part and an outer part adjacent the main part wherein the outer part is located intermediate the first and second apertures wherein the outer part is so constructed to be folded out of alignment with the main part.

A second aspect of the invention provides an article carrier for packaging articles having a necked portion, wherein an article receiving and retaining arrangement is struck from the top panel of the carrier. The arrangement comprises an aperture formed in part in the top panel and a flap struck from the top panel and hingedly connected to the edge of the aperture. The flap is folded inwardly of the top panel into an operative position about its hinged connection to provide a portion thereof which extends inwardly of the carrier. The portion of the flap is adapted to engage a neck portion of an article retained in the aperture.

A third aspect of the invention provides a blank comprising opposed side wall panels and a top panel being foldably interconnected, an article receiving and retaining arrangement formed from the top panel, said arrangement comprising an aperture adapted to receive a portion of an article in use and a flap struck from the top panel and hingedly connected to an edge of said aperture which flap is adapted to abut the article received in the aperture in use, wherein the flap is adapted to pivot into an operative position about its hinged connection to provide a portion there of which extends through the aperture in use, the portion of said flap being adapted to engage a neck part of the article.

An advantage of the carrier outlined in any one of the aspects of the invention may be that there is provided a carton which can package two or more rows of cartons and/or the top panel to be defined which is not limited in its dimensions, thereby improving carrying capabilities in those carriers with handle means. Beneficially, a larger area of the side panel can be used as an advertising panel.

Embodiments of the invention will now be described by way of example only, with reference to the accompanying drawings in which:

DETAILED DESCRIPTION OF THE PREFERRED EMBODIMENTS

Figure 1:
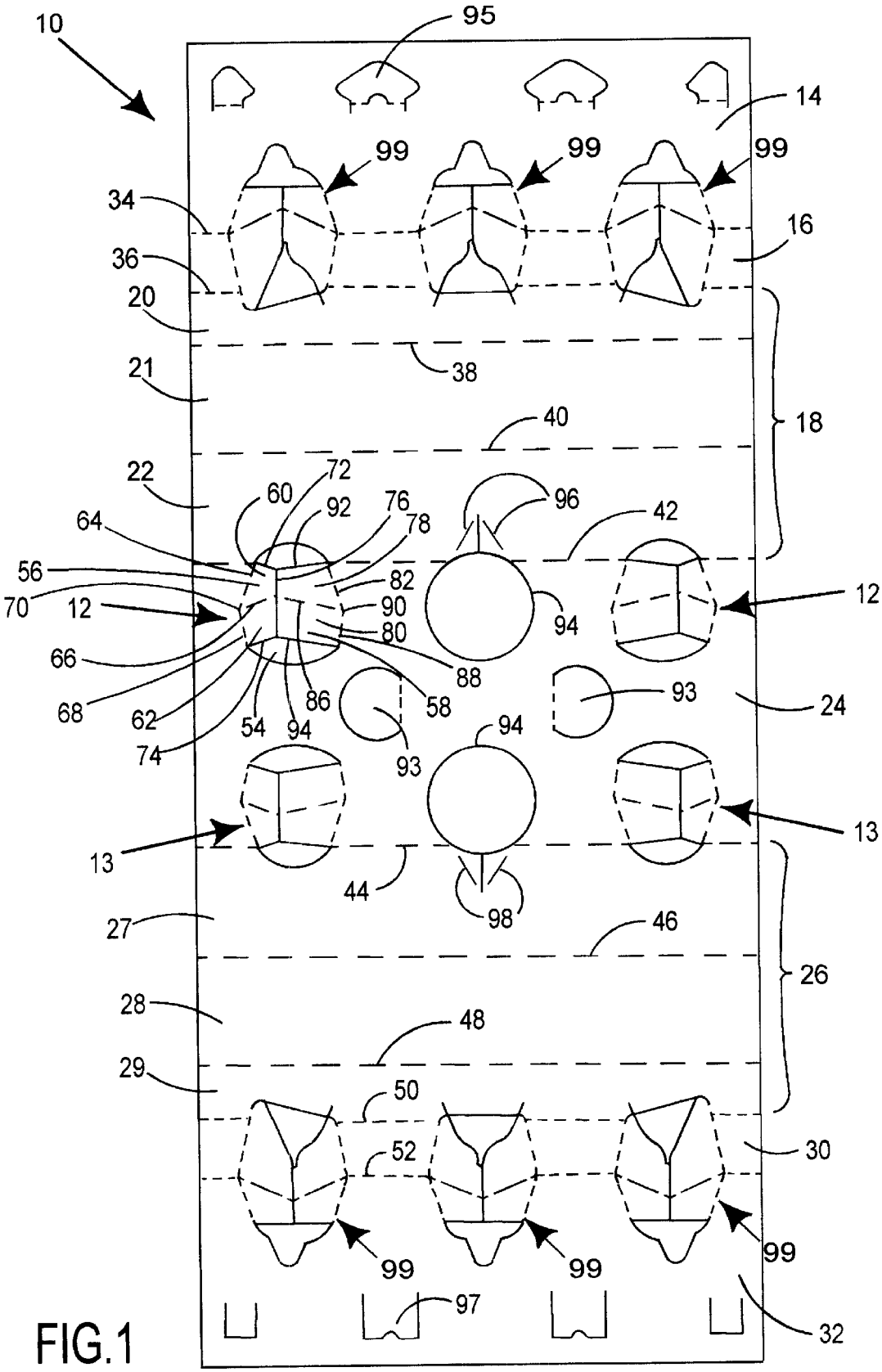
FIG. 1 is a plan view of an article engaging and retaining arrangement according to a first embodiment of the invention in a uniform blank.
Figure 2:
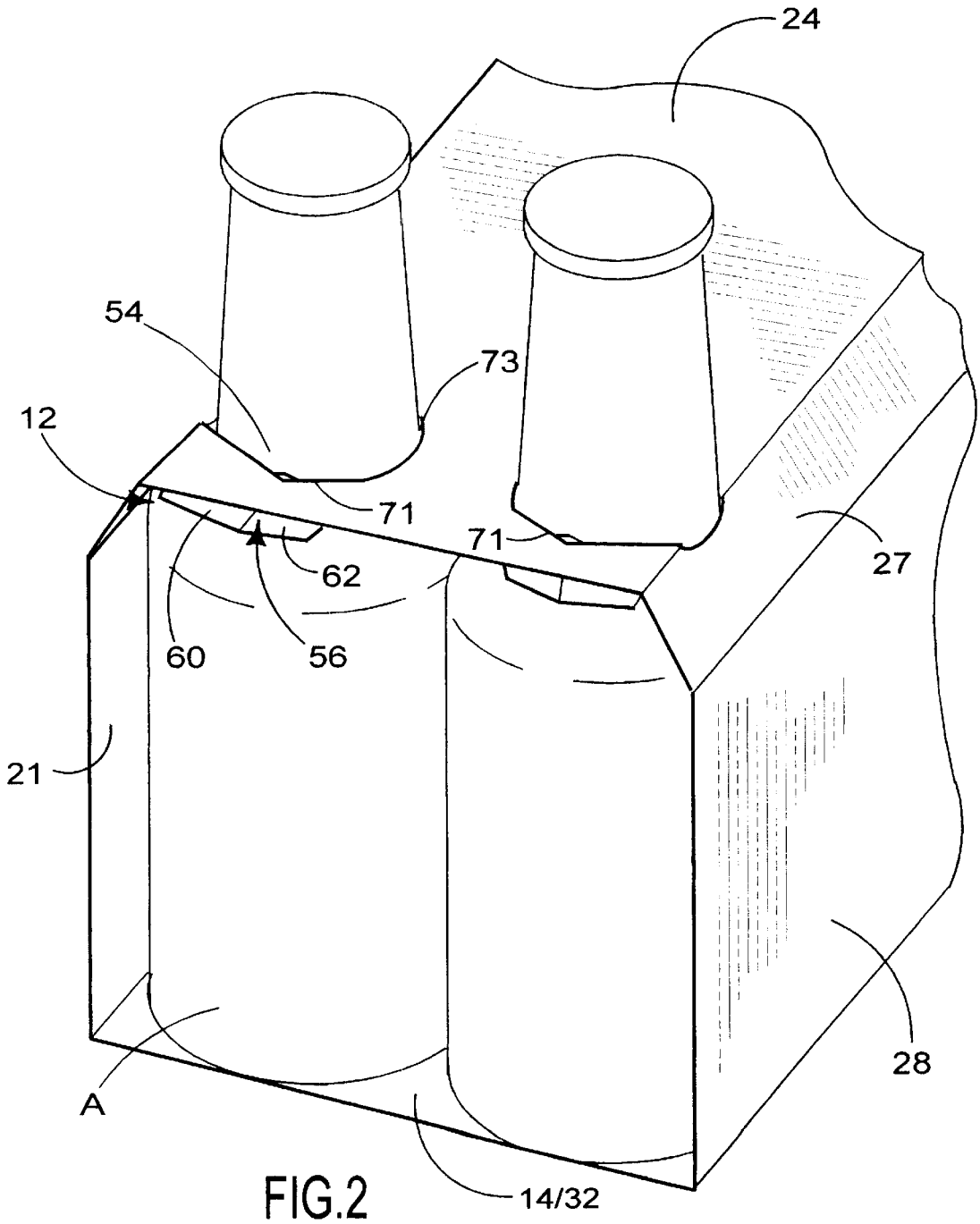
FIG. 2 is a perspective view of the article engaging and retaining arrangement shown in FIG. 1 in a formed condition in engagement with article A.

Referring to the drawings, and in particular FIGS. 1 and 2 thereof, an article carrier is formed from one or more blanks of paperboard or other suitable foldable sheet material. The article carrier is adapted to accommodate a plurality of articles, for example six bottles arranged in two rows of three bottles each. It is envisaged the carton can be adapted to accommodate a different number and/or configuration of articles, according to user requirements.

In this embodiment, the blank 10 comprises a first base panel 14, inclined heel (or sloping) panel 16, first side panel 18 comprising lower, middle and upper side panels 20, 21 22, top panel 24, second side panel 26 comprising upper, middle and lower side panels 27, 28, 29, inclined heel panel 30 and second base panel 32 hingedly connected one to the next along fold lines 34, 36, 38, 40, 42, 44, 46, 48, 50 and 52 respectively. Article receiving and retaining arrangement 12 which can be of a known type as shown in FIG. 1 is formed in a top wall 24 of a wrap-around carrier. The article receiving and retaining arrangement 12 can be formed at the ends of the tubular structure of a wraparound carton, for example to retain the end comer articles (as shown in FIG. 1) or alternatively, can be provided for one or more of the articles held in a carrier.

The article receiving and retaining arrangement 12 comprises a retaining aperture 54 which, in this example, receives the neck portion of a bottle, as shown in FIG. 2. The article receiving and retaining arrangement 12 may also comprise one or more retaining flaps 56, 58 which in the formed carton, provide internal flap portions that abut part of the neck of an article A.

Turning in detail to the article receiving and retaining arrangement 12 in this particular embodiment, there comprises a first flap 56 including outer, and inner flap portions 60, 62 respectively. Outer flap portion 60 is hinged to top wall 24 along fold line 64, and to inner flap portion 62 along fold line 66. Inner flap portion 62 is hinged to top panel 24 along fold line 68. As shown in FIG. 1, fold lines 64 and 68 diverge inwardly of aperture 54 and thereby provide two angularly related parts of a fold line by which first flap 56 is hinged to top panel 24.

Optionally, a cut line 70 is struck from fold line 64 and fold line 68 at their interconnection to make folding easier and can define a portion which extends upwardly above the top panel, as illustrated in FIG. 2. First flap 56 may be struck from top panel 24, to define an outer side edge 72, and an inner side edge 74 which are interconnected by a cut line 76 defining an end edge of first flap 56. First flap 56 is pivotal about the fold lines 64 and 66 such that these fold lines 64, 66 and optional cut line 70 together define a lateral edge 71 of aperture 54 in use, as shown in FIG. 2.

Similarly, a complementary second flap 58 comprises outer, and inner flap portions 78, 80 respectively. In this embodiment, second flap 58 is a larger area than of first flap 56. It is anticipated that the first and second flaps 56, 58 need not necessarily be different sizes and could be identical in construction. Optionally, one flap only might be provided for a given article receiving and retaining arrangement 12. It is envisaged that where two flaps are provided, they need not abut along cut line 76 and indeed, a significant gap could be provided between the flaps, for example.

Turning to the construction of second flap 58, the outer portion 78 is foldably connected to top wall 24 along fold line 82 and to inner portion 80 along fold line 86. Inner portion 80 is hingedly connected to top panel 24 along fold line 88. Likewise, a second cut line 90 can be optionally provided to separate fold line 82 from fold line 86. Second flap 58 is struck from top panel 24, to define an outer side edge 92 and an inner side edge 94 which is interconnected by cut line 76 defining one end edge of second flap 58. Second flap 58 is pivotal about fold lines 82, 88 such that these fold lines 82, 88 and cut line 90 together define an opposing lateral edge 73 of aperture 54, as shown in FIG. 2. When both flaps 56, 58 are co-planer, such as when the carrier is in blank form illustrated in FIG. 1, the aperture 54 is substantially closed. Optionally, the aperture 54 may extend into the side wall 18.

In this embodiment, the carrier is formed to package two rows of three articles. The blank 10 shown in FIG. 1, comprises a further article receiving and retaining arrangement 12 for one row of articles formed from top wall 24. In addition, article receiving and retaining arrangement 13 for a second row of articles is also formed from top wall 24. Article receiving and retaining arrangement 13 is substantially the same as retaining arrangement 12 and is therefore not described in any greater detail.

In the embodiment shown in FIG. 1, there may further comprise a pair of apertures 94, adapted to receive articles positioned intermediate the end most articles. These apertures can support a neck portion of the articles and may optionally include a pair of substantially "V" shaped cut lines 96, 98 struck from the side panels 18, 26 to define fold lines for support tabs that protrude outwardly of the side wall 18. The carton can also include article heel retention means 99 formed from the panels, as is well known in the art. Handle tabs 93 may be struck from top panel 24. Suitable known securing means are provided to secure the base panels together. In this embodiment, locking and retaining tabs 95, 97 are provided as is well known.

Turning to the second and third embodiments illustrated in FIGS. 3, 4 and 5, 6 respectively, there comprises additional or alternative modifications to article engaging and retaining arrangement and/or to the carton of the invention. Each embodiment can be applied to a wraparound carton of the type substantially as herein before described and so only the differences of the carrier of the second and third embodiments are described in any greater detail.

Figure 3:
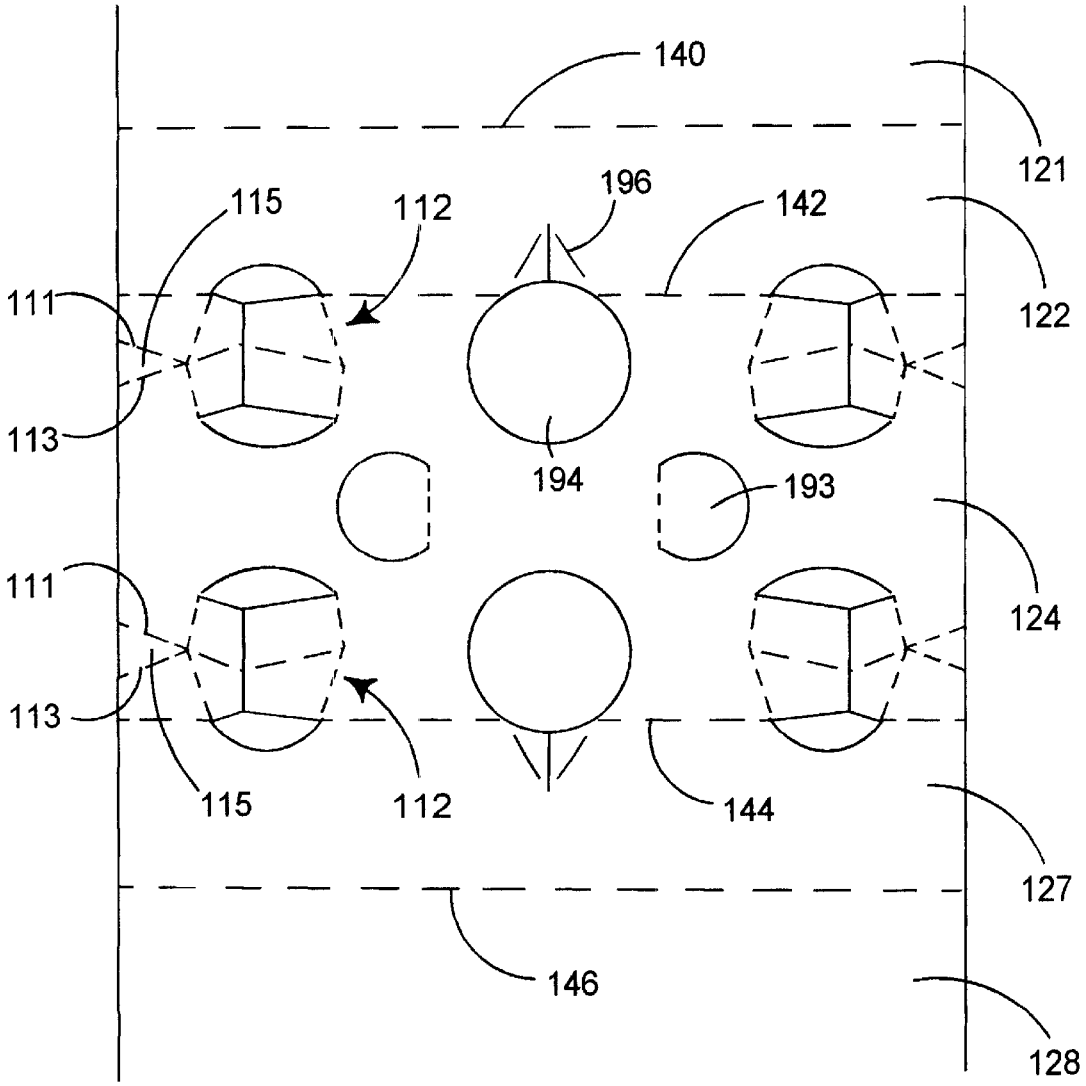
FIG. 3 is a plan view of the article engaging and retaining arrangement according to a second embodiment of the invention.

The second embodiment illustrates article receiving and retaining arrangement 112 formed in the top panel 124 which corresponds to article receiving and retaining arrangement 12 illustrated in FIG. 1, with corresponding features shown in FIG. 3 prefixed by the numeral "1". Thus, the second embodiment illustrates article receiving and retaining arrangement 112 which further comprises a pair of divergent fold lines 111, 113 struck from top panel 124 and extending outwardly from the intersection of fold lines 164 and 166 to the end edges of top panel 124 to define intermediate panel 115. Fold lines 111, 113 are intended to act as stress relief folds. Further or alternatively intermediate panel 115 may be moved out of the plane of top panel to minimise unwanted flexing of top panel 124, thereby to improve the rigidity of the end portion of the top panel.

Figure 5:
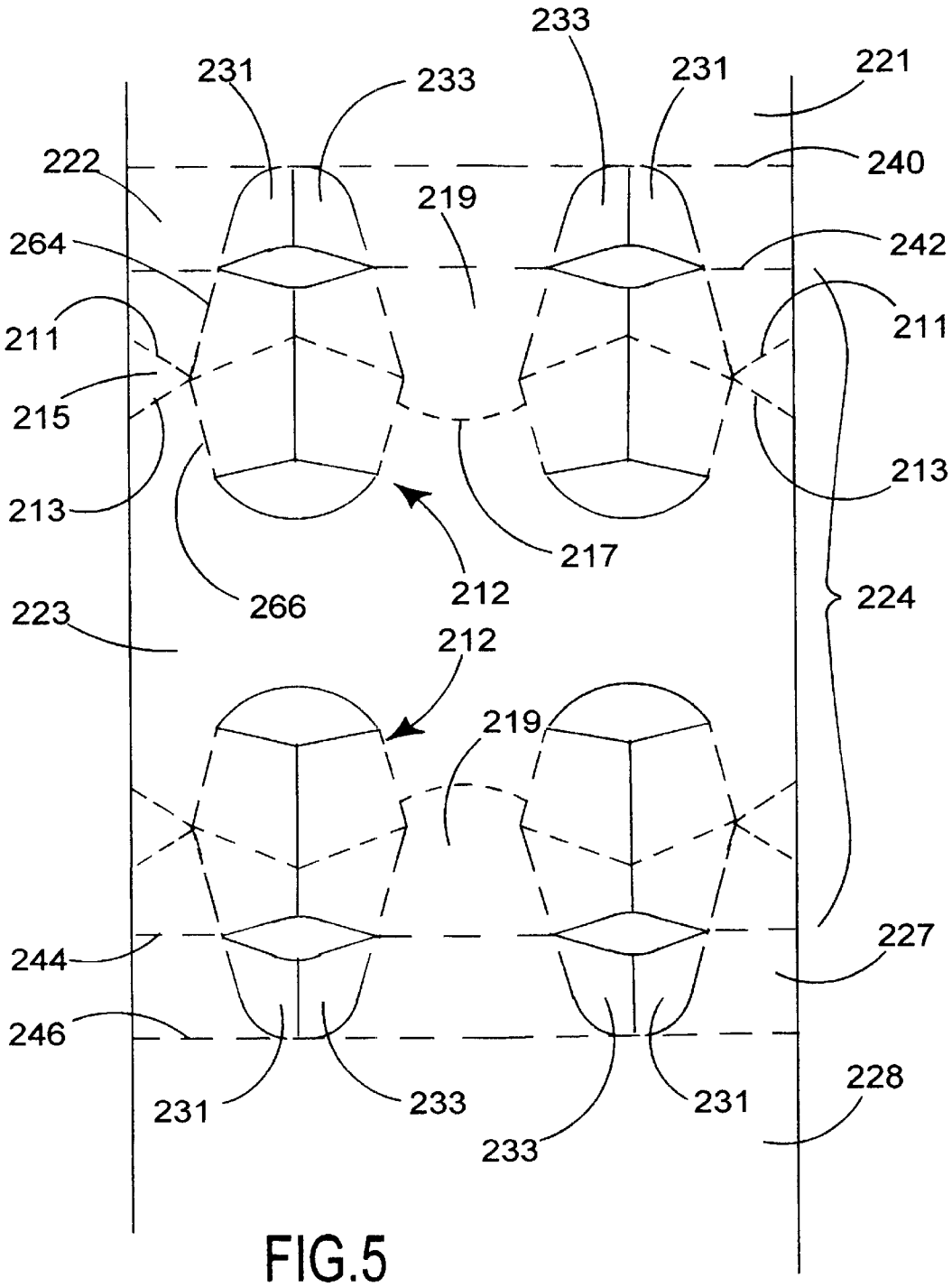
FIG. 5 is a plan view of the article engaging and retaining arrangement according to a third embodiment of the invention.

Turning to the third embodiment which is adapted for large glass bottles, there is illustrated article receiving and retaining arrangement 212 formed in the top panel 224 which corresponds to article receiving and retaining arrangement 12 illustrated in FIG. 1, with corresponding features shown in FIG. 5 prefixed by the numeral "2". Thus, the third embodiment illustrates the or each article receiving and retaining arrangement 212 which further comprises a pair of divergent fold lines 211,213 struck from top panel 224 and extending outwardly from the intersection of fold lines 264 and 266 to the end edge of top panel 224 to define intermediate panel 215. Fold lines 211, 213 are intended to act as stress relief folds. Further or alternatively intermediate panel 215 may be moved out of the plane of top panel to minimise unwanted flexing of top panel 224. There may further comprises an additional fold line 217 interconnecting adjacent article engaging and retaining arrangement 212 to define a top panel portion 219 that is positioned out of alignment to the main portion 223 of top panel 224, thereby to minimise unintended flexing of the top panel 224, thereby to improve the rigidity of the top panel.

Optionally, the article receiving and retaining arrangement 212 may further comprise a pair of flaps 231,233 struck from and foldably connected to each upper side panel

222,227 illustrated in FIG. 5, which are adapted to be folded out of alignment with the associated upper side panel 222,227, to receive and retain a shoulder portion of the article A.

In order to erect a wraparound carrier comprising article receiving and retaining arrangement 12, the flaps 56, 58 are displaced inwardly by suitable means which may be similar, at least in function to those known, for example from WO 94/25363. In the first embodiment, the top panel 24 of the carrier blank 10 is applied to the tops of a group of articles A to be packaged in the carrier, and the side walls 18, 26 folded downwardly to be disposed in flanking relationship along the side walls of the articles. The neck portion of an article A is thereby engaged in the aperture 54 and is also received by the flaps 56, 58 of article receiving and retaining arrangement 12. Preferably, each flap is folded during the set up of the article engaging and retaining arrangement about fold line 64, 66, 68; 82, 86, 88 respectively to move outer and inner flap portions out of alignment and into abutment with a neck portion of the article A as shown in FIG. 2.

Thereafter, heel retention flaps of article heel retention means 99 are formed to receive and retain a heel portion of the articles as is well known. Base panel 14 can then be folded inwardly and upwardly into engagement with the base portions of the articles A as illustrated in FIG. 2. A similar operation on the other side of the group of articles is also performed, and the wraparound carrier can be completed by securing the overlapping base panels 14, 32 together by means known in the art, for example by gluing or preferably by the use of locking and retaining tabs 95,97 as is well known.

Thus, the carrier is in a set-up condition, shown in FIG. 2 and the article receiving and retaining arrangement 12 is formed such that the internal retaining flap portions 60, 62, 78, 80 are provided to engage the neck of article A and to closely conform to the neck portions of the articles thereby to prevent unwanted movement of the articles in the carrier and to reduce the risk of tearing.

Figure 4:
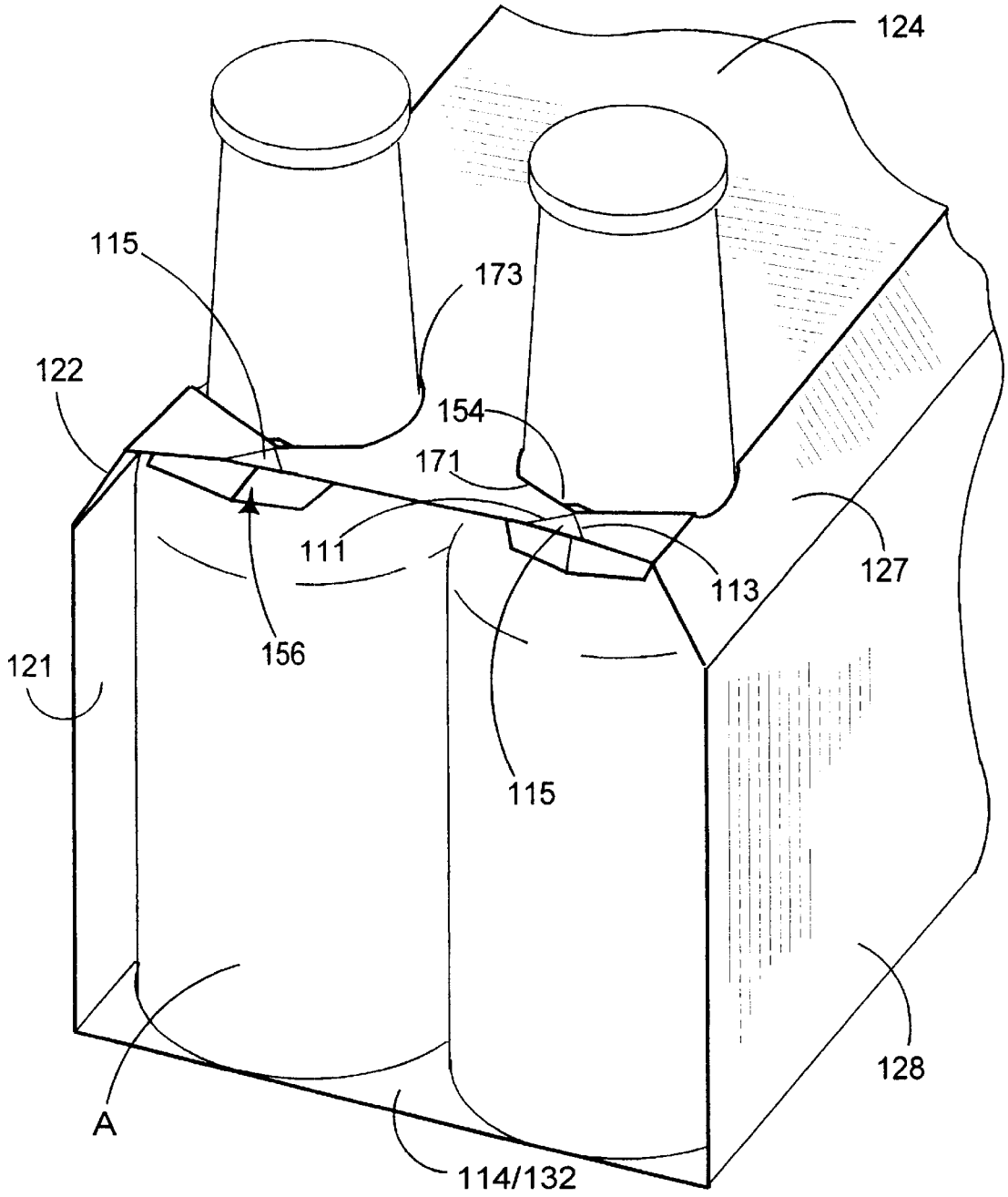
FIG. 4 is a perspective view of the article carrier shown in FIG. 3.
Figure 6:
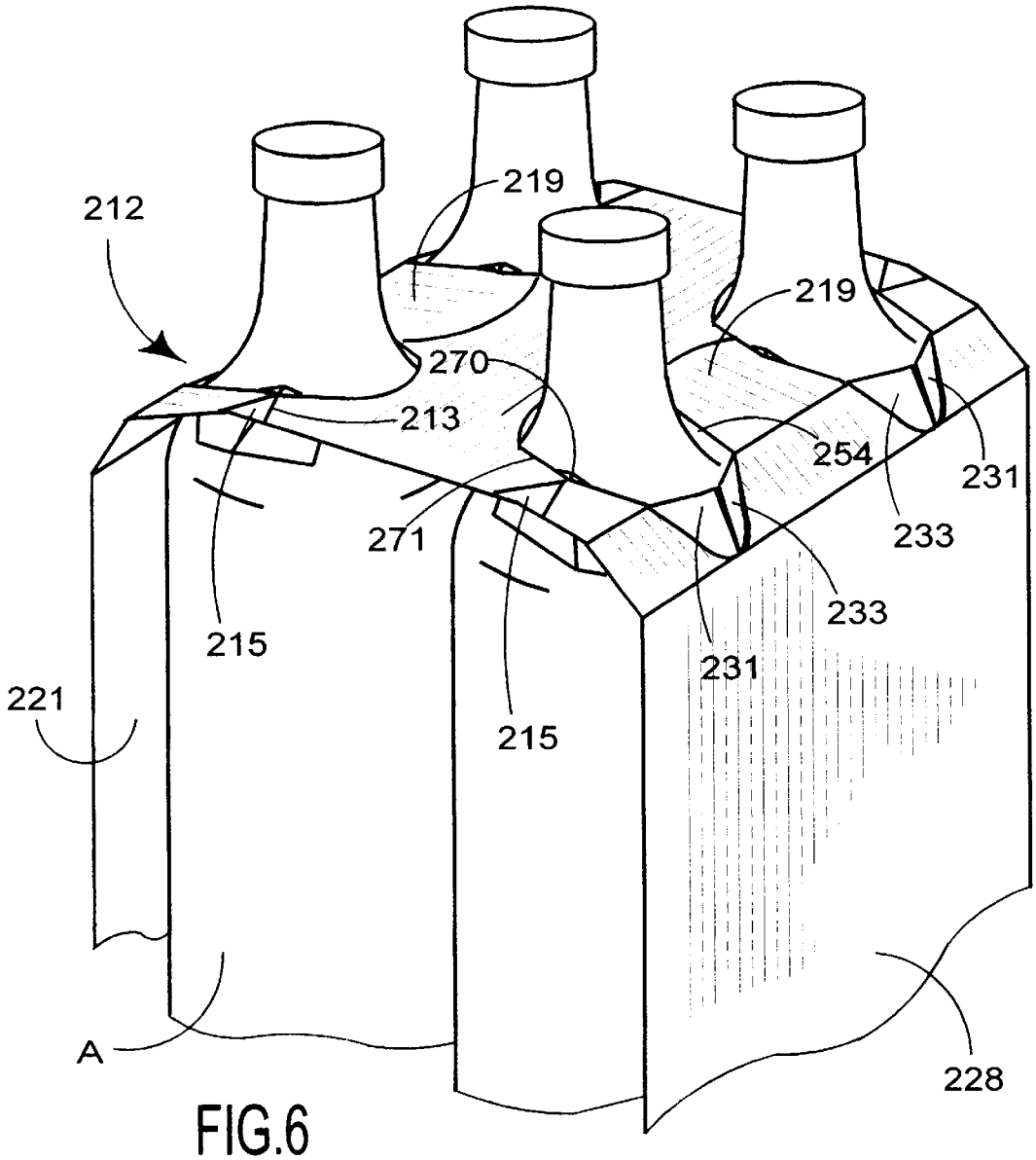
FIG. 6 is a perspective view of the article engaging and retaining arrangement shown in FIG. 5.

The construction of the second and third embodiments is substantially the same as the first embodiment to produce carriers illustrated in FIGS. 4 and 6 respectively and therefore only the differences are described in any greater detail. FIGS. 4 and 6 show intermediate panels 115, 215 that are folded out of alignment with top panel 124, 224 respectively.

It will be seen from FIG. 6 that the third embodiment includes flaps 231,233 that are folded out of alignment with upper side panels 222, 227 to receive a shoulder portion of the articles. Outer parts 219 of the top panel are folded out of alignment with main portion 223 to form a carrier shown in FIG. 6.

It is apparent that a large amount of paperboard may be put into contact with the retained article using a retaining structure according to the invention, thereby providing both protection and securing for the article. It is preferable to use a two part article engaging flap i.e. inner and outer portions 60,62;78,80 so that they are folded about fold line 66;86 respectively to define two angularly related parts. Each part desirably abuts a portion of the neck of the article to improve article retention. Additionally, the improved conformity of the retaining flaps and of those embodiments with intermediate panel 115 and/or top panel portion 219 enables a relatively strong pack tightening whilst minimising the risk of tearing.

Further, the invention is not limited to a configuration as described above, and it is envisaged, it would be possible to provide article retaining arrangement according to the invention comprising one or more hinged means per retaining flap to be provided in the assembled carrier.

It will be recognized that as used herein, the terms "top", "bottom" and "side" with respect to the panels of the carton (or carton blank) are relative terms, and that the carton (formed from the blank) may be reoriented as necessary or as described.

It will be recognized that rather than the carton being formed with a plurality of the article receiving apertures, the carton may be formed with only one receiving aperture.

The present invention and its preferred embodiment relate to an article carrier which is shaped to provide satisfactory strength to hold the bottle securely but with a degree of flexibility so that the load transferred to the retaining arrangement is absorbed by the carrier. The shape of the blank minimises the amount of paperboard required. The carrier can be applied to an array of bottles by hand or automatic machinery. It is anticipated that the invention can be applied to a variety of carriers and not limited to those of the wraparound type.

What is claimed is:

1. An article carrier for containing a plurality of necked articles comprising top, bottom and opposed side panels interconnected together to form a tubular structure, wherein said top panel comprises an article receiving and retaining arrangement which comprises a first retaining flap formed from said top panel, said retaining flap being foldably joined to said top panel along a first fold line, said retaining flap being folded inwardly of said tubular structure and defining an aperture for receiving a neck portion of an article whereby said retaining flap abuts the neck portion to engage and retain the article when the neck portion is received in said aperture, and wherein said first fold line comprises two angularly related parts diverging inwardly of said aperture.

2. The article carrier according to claim 1 wherein said retaining flap is formed with a medial fold line extending across said retaining flap such that said retaining flap is folded along said medial fold line to define a pair of adjacent flap portions adapted to abut the neck portion at two positions thereby to improve article retention, and wherein said adjacent flap portions are hingedly connected to said top panel along said two angularly related parts respectively.

3. The article carrier according to claim 1 wherein said article receiving and retaining arrangement further comprises a second retaining flap foldably joined to said top panel along a second fold line, said second retaining flap being folded inwardly of said tubular structure and defining said aperture in cooperation with said first retaining flap, said second fold line being located transversely opposed to said first fold line with respect to said aperture and comprising two angularly related parts diverging inwardly of said aperture.

4. The article carrier according to claim 1 further comprising stress fold lines diverging outwardly from said aperture to an end edge of said top panel.

5. An article carrier for packaging articles, including an article receiving and retaining arrangement comprising an aperture defined in a top wall panel and a flap hingedly connected to an edge of said aperture by a hinged connection, said flap being folded inwardly of said carrier into an operative position about said hinged connection to provide a portion of said flap which extends inwardly of said carrier, said portion of said flap being adapted to engage a neck portion of an article retained in said aperture, wherein said hinged connection comprises a fold line having two angularly related parts diverging inwardly of said aperture.

6. An article carrier for containing a plurality of necked articles, comprising a top panel and a pair of opposed side panels foldably connected respectively to opposite side edges of said top panel, wherein said top panel comprises an article receiving and retaining arrangement including an article retaining flap formed from said top panel, said retaining flap being foldably joined to said top panel along a fold line, said retaining flap being folded inwardly of said top panel along said fold line and thereby defining an aperture for receiving a neck portion of one of the articles, wherein said fold line comprises two angularly related parts diverging inwardly of said aperture.

7. The article carrier according to claim 6 wherein said two angularly related parts diverge from a point within said top panel, said point being disposed at a position spaced from an adjacent one of said opposite side edges of said top panel.

8. The article carrier according to claim 6 wherein said two angularly related parts diverge from a converging point, and wherein said retaining flap is formed with a medial fold line extending across said retaining flap such that said retaining flap is folded along said medial fold line upon folding of said retaining flap about said two angularly related parts, said medial fold line extending from said converging point to a free end of said retaining flap.

9. An article carrier for containing a plurality of necked articles comprising top, bottom and opposed side panels interconnected together, wherein said top panel comprises an article receiving and retaining arrangement which comprises a first retaining flap folded inwardly of said top panel, said retaining flap defining an aperture for receiving a neck portion of an article whereby said retaining flap abuts the neck portion to engage and retain the article when the neck portion is received in said aperture, wherein said retaining flap is formed from said top panel, wherein said retaining flap is foldably joined to an edge of said aperture along a fold line comprising two angularly related parts, and wherein said angularly related parts converge on a point where a pair of stress relief fold lines converge, said stress relief fold lines defining therebetween an intermediate panel adjacent an end edge of said top panel.

10. A blank comprising a top panel, opposed side wall panels hingedly connected to said top panel, an article receiving and retaining arrangement comprising an aperture adapted to receive a portion of an article in use and a first flap hingedly connected to an edge of the aperture, said flap being adap ted to abut said article received in the aperture in use, wherein said flap is adapted to pivot into an operative position about a hinged connection thereof to provide a portion thereof which extends through the aperture in use, said portion of said flap being adapted to engage a neck part of the article, and wherein said flap is formed from said top panel, wherein said flap is foldably joined to an edge of the aperture along a fold line comprising two angularly related parts, and wherein said angularly related parts converge on a point where a pair of stress relief fold lines converge, said stress relief fold lines defining therebetween an intermediate panel adjacent to an end edge of said top panel.

* * * * *